US005164545A

United States Patent [19]

Kreinberg et al.

[11] Patent Number: 5,164,545

[45] Date of Patent: Nov. 17, 1992

[54] GROUNDING CONNECTOR

[75] Inventors: Earl R. Kreinberg, Peoria; Marty E. Adcock, Scottsdale, both of Ariz.

[73] Assignee: AMP Incorporated, Harrisburg, Pa.

[21] Appl. No.: 754,873

[22] Filed: Sep. 4, 1991

Related U.S. Application Data

[63] Continuation-in-part of Ser. No. 624,858, Dec. 10, 1990, abandoned.

[51] Int. Cl.[5] ..... H01R 4/18

[52] U.S. Cl. ..... 174/94 R; 174/78; 174/84 C; 439/879

[58] Field of Search ..... 174/94 R, 78, 84 C; 439/217, 790, 877, 879

[56] References Cited

U.S. PATENT DOCUMENTS

| | | | |
|---|---|---|---|
| 2,749,383 | 6/1956 | Pigman et al. | 174/84 C |
| 3,168,615 | 2/1965 | Owen et al. | 174/84 C |
| 3,320,354 | 5/1967 | Marley et al. | 174/84 C |
| 3,410,950 | 11/1968 | Freudenberg | 174/84 C |
| 3,514,528 | 5/1970 | Ray | 174/84 C |
| 3,553,347 | 1/1971 | Harding et al. | 174/84 C |
| 3,715,456 | 2/1973 | Faulkner | 174/84 C |
| 3,715,705 | 2/1973 | Kuo | 174/94 R |
| 3,838,387 | 9/1974 | Grillet | 174/94 R |
| 4,875,876 | 10/1989 | O'Loughlin | 439/431 |
| 4,922,058 | 5/1990 | Rodrigues | 174/94 R |
| 5,004,869 | 4/1991 | Koblitz et al. | 174/84 C |

FOREIGN PATENT DOCUMENTS 731999 2/1943 Fed. Rep. of Germany .... 174/94 R

*Primary Examiner*—Morris H. Nimmo
*Attorney, Agent, or Firm*—Anton P. Ness

[57] ABSTRACT

A grounding connector for interconnecting a ground wire with a pipe in a one-piece stamped and formed member (10) which includes an outer section having diverging walls (14,16) extending from a base section (12) to form a V-shaped channel (18), upper sections (20,22) of the walls (termed outer walls) being crimpable toward each other and locked in a vertical orientation when applied to the pipe (70) and wire (68). An inner section (30) extends integrally from the top (24) of one outer wall (20) and is latchable to the top (24) of the other outer wall (22), and includes a pair of inner walls (36,40) joined by a central arcuate portion (38) crossing the top of the U-shaped channel (18). When the outer and inner walls (20,36;22,40) are crimped to a vertical orientation and locked, the rotated inner walls (36,40) urge the central portion (38) downwardly against the large diameter pipe (70) which in turn engages upper edges (64) of a pair of insert tabs (52,54) partially rotating them to urge other tab edges (62) under spring bias against the ground wire (68) in the V-shaped channel (18) below the insert tabs (52,54). The insert tab edges (62,64) penetrate corrosion on the surface of the pipe (70) and ground wire (68) to establish a ground connection having stored energy from the spring bias.

14 Claims, 5 Drawing Sheets

GROUNDING CONNECTOR

CROSS-REFERENCE TO RELATED APPLICATIONS

This is a continuation-in-part of U.S. patent application Ser. No. 07/624,858 filed Dec. 10, 1990, now abandoned, and is filed concurrently with U.S. patent application Ser. No. 07/754,884.

FIELD OF THE INVENTION

This relates to the field of electrical connectors and more particularly to grounding connectors.

BACKGROUND OF THE INVENTION

In certain electrical wiring arrangements such as in utilities or in telecommunications, it is necessary to interconnect a pair of uninsulated conductors to establish a system ground. Where the conductors are uninsulated for long periods of time prior to being interconnected, a substantial layer of corrosion forms on the conductor surfaces having a thickness of about 0.001 inches and in spots up to about 0.0035 inches. It is necessary for the connector selected to interconnect a pair of such corrosion-encrusted conductors, to establish an assured electrical connection with the conductive portion of the conductors beneath the corrosion layer, sufficient to establish a ground connection. It is also necessary for the connector to remain firmly secured to the conductors and assuredly electrically interconnecting them over long in-service use, while exposed to the environment.

It is desirable to be able to apply a connector directly to the corrosion-encrusted conductors rather than involve a procedure to remove the corrosion prior to application. It is further desirable for such a connector to be easily applied without special tools or involving an operator-sensitive procedure. It is also desirable for the connector to provide a visual indication of an assured electrical connection.

It is additionally desirable for such a connector to be applicable to a pipe for establishing a grounding connection of a ground wire.

Further, it is desirable for such a connector to be formed of a single component and not require assembly.

SUMMARY OF THE INVENTION

The present invention is an integral component which includes a pair of initially diverging sections extending from a bight section in a V shape together defining a conductor-receiving region between opposed clamping surfaces; when the body sections are manipulated or squeezed into an applied configuration, the clamping surfaces are urged toward each other and against the conductors and thereby establish a ground connection between the conductors. Preferably an insert section is disposed in the conductor-receiving region between the clamping surfaces defining discrete conductor-receiving passageways and against which the conductors are clamped. The insert section includes engagement edges extending toward the clamping surfaces and having profiles shaped selectively to match the surfaces of the respective conductors. The connector defines a pair of separate passageways into which the conductors are inserted, after which the connector is deformed such as by pliers to clamp the conductors against the profiled engagement edges of the insert section. Preferably the insert section includes a pair of spaced engagement edges engageable with each of the respective conductors at locations axially spaced therealong, adapted to break through corrosion formed on the conductor surfaces.

The component includes a base section and a pair of initially diverging walls extending upwardly to upper ends from the base section to form a V-shaped (or optionally a U-shaped) channel into which the first conductor, such as a wire, is disposed. Formed integrally with one of the upper wall ends is a clamping section which will ultimately be rotated about the upper wall end to latch at its flanged free end with a corresponding flange on the other upper wall end to extend between the wall ends in which position it will be locked after the connector is mounted about a portion of a continuous second conductor such as a pipe. The clamping section when locked in position above the upper conductor includes wall sections extending inwardly and downwardly at an angle toward the upper conductor and are joined by a central portion. The inside surfaces of the base section and the central portion of the clamping section define opposed first and second clamping surfaces, which face respective first and second conductor-receiving regions.

When the connector has been mounted about the first and second conductors with the conductors disposed in the conductor-receiving regions and the clamping section locked in position, the upper sections of the diverging walls are squeezed toward each other such as by pliers until rotated into a vertical orientation, with the lower wall sections adapted to be between about the large diameter second or upper conductor such as a pipe. The rotated upper wall sections, or outer wall sections, are brought against the wall sections of the clamping section, or inner wall sections, to cause them to be likewise rotated into a vertical alignment bout the integral joints with the central portion. Upon rotation, the inner wall sections urge the central portion toward the base section and press the conductor in the passageways against the clamping surfaces and against the insert section therebetween.

The inset section preferably includes a pair of first edges extending downwardly to engage the first or lower conductor at spaced locations axially along the first conductor, and a pair of second edges extending upwardly to engage the second or upper conductor which may be a larger diameter pipe. Each edge is profiled to be arcuate and correspond to the round surface of the first conductor thus engaging the conductor at several locations about the circumference. Further, each of the first and second edges is defined along a plate portion of the insert section which is preferably angled from the vertical, and upon engagement with the first conductor during crimping, becomes deflected to a greater angle form the vertical to wipe along the conductor surface axially breaking through the corrosion and also becoming spring biased against the conductor surface after full crimping. Preferably the insert section comprises a pair of plate sections extending between a first and second engagement edge of each pair thereof, and joined to respective wall sections proximate the base section by respective straps capable of being twisted during crimping as the plate sections are rotated by the first and second conductors upon engagement therewith.

The connectors can be fabricated by being stamped from a single strip of metal and the various sections thereof can be formed, resulting in a single piece; preferably the connector can be made of copper alloy such as brass or made of deformable stainless steel.

The connector of the present invention is adapted to groundingly connect a round wire to a larger diameter pipe (or rod). The base section of the outer body member is essentially V-shaped with the apex of the V being round to receive the smaller diameter wire therealong, while the central portion of the clamping section is convex upwardly with a radius approximately matching the diameter of the pipe (or rod), such as one having a one-half inch diameter.

The connector preferably includes means for locking the vertically-rotated wall sections together upon full crimping for an assured mechanical connection to the wire and pipe. Such locking means can comprise a pair of tabs formed from the inner wall sections of the clamping section to extend generally inwardly from the ends thereof but formed to be angled outwardly away from the central portion; free ends of the tabs will extend to each other upon rotation of the outer and inner wall sections and will become lockingly engaged by means of a locking projection of one free end becoming caught behind a locking surface of a slot through the other. The locking arrangement provides a mechanical assurance of full crimping and a visual indicator thereafter.

It is an objective of the present invention to provide an electrical grounding connector easily applied to uninsulated conductors of certain dimensions to establish a grounding connection therebetween without requiring special tools or particular skill.

It is another objective for the connector to be especially adapted to be applied to corroded conductors and penetrate the corrosion upon simple application to establish an assured grounding connection therebetween.

It is yet another objective for the connector to be usable with a wire and a large diameter rod or pipe.

It is additionally an objective for such connector to be a single piece not requiring assembly of parts, and adapted to be easily mounted around intermediate portions of continuous conductors upon application.

It is still another objective for the connector to provide a mechanical and visual indication of assured connection.

It is also an objective of the connector of the present invention to be fabricated at low cost.

An embodiment of the grounding connector will now be disclosed by way of example with reference to the accompanying drawings.

BRIEF DESCRIPTION OF THE DRAWINGS

FIGS. 1 to 3 are isometric illustrations of the grounding connector of the present invention in an open, closed and fully crimped configuration respectively with the conductors not shown;

DETAILED DESCRIPTION OF THE PREFERRED EMBODIMENTS

Figure 1:
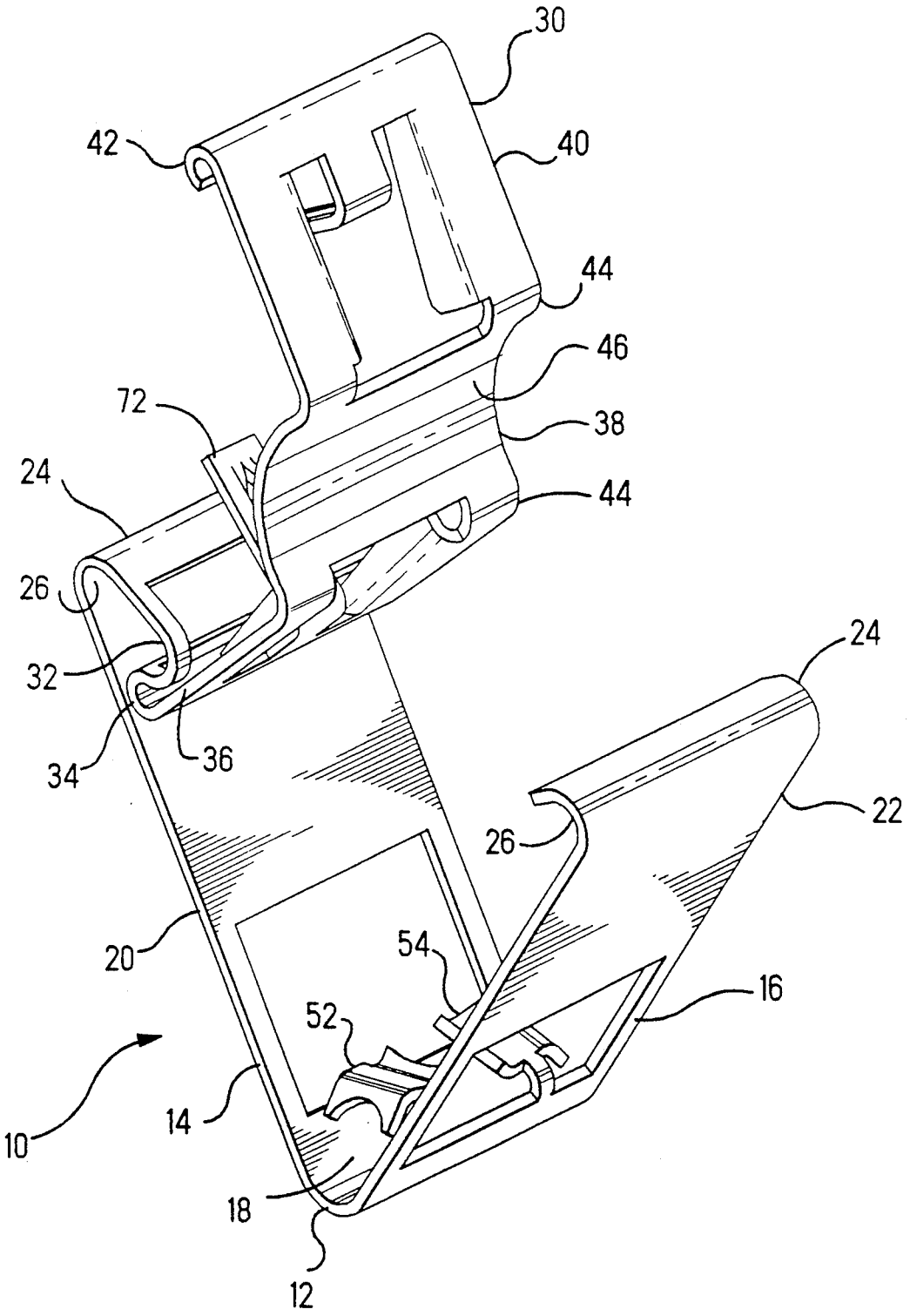
Figure 2:
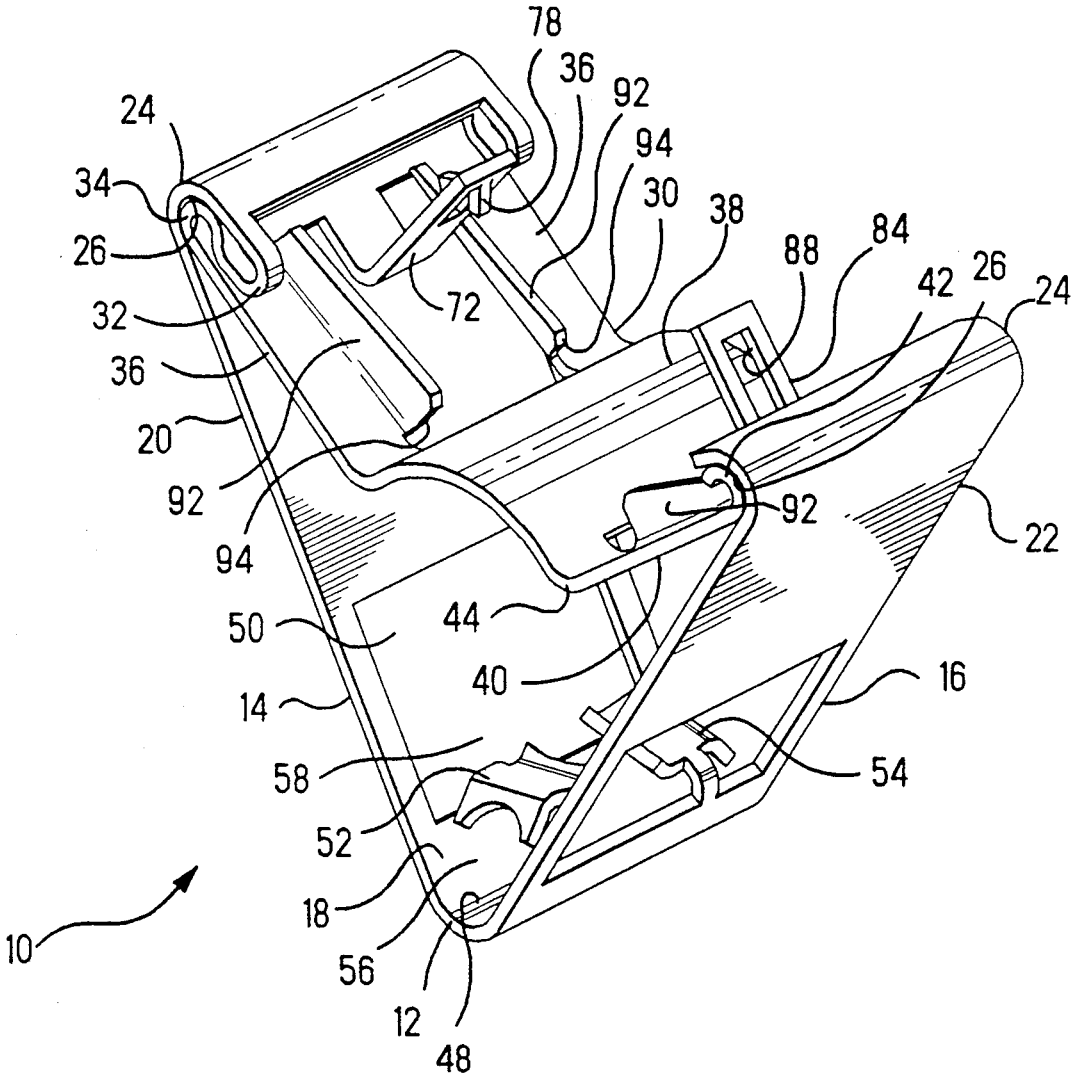

Grounding connector 10 is shown in FIG. 1 after being stamped and formed from a single strip of metal such as brass or stainless steel. Connector 10 is to be applied to intermediate portions of continuous lengths of conductors such as a ground wire and a larger diameter pipe by being mountable around the conductors. FIG. 2 illustrates the connector 10 as it would appear after being disposed around the conductors but not yet crimped thereto, and FIG. 3 illustrates the configuration of the connector as it would appear after crimping, with the conductors not shown.

Figure 5:
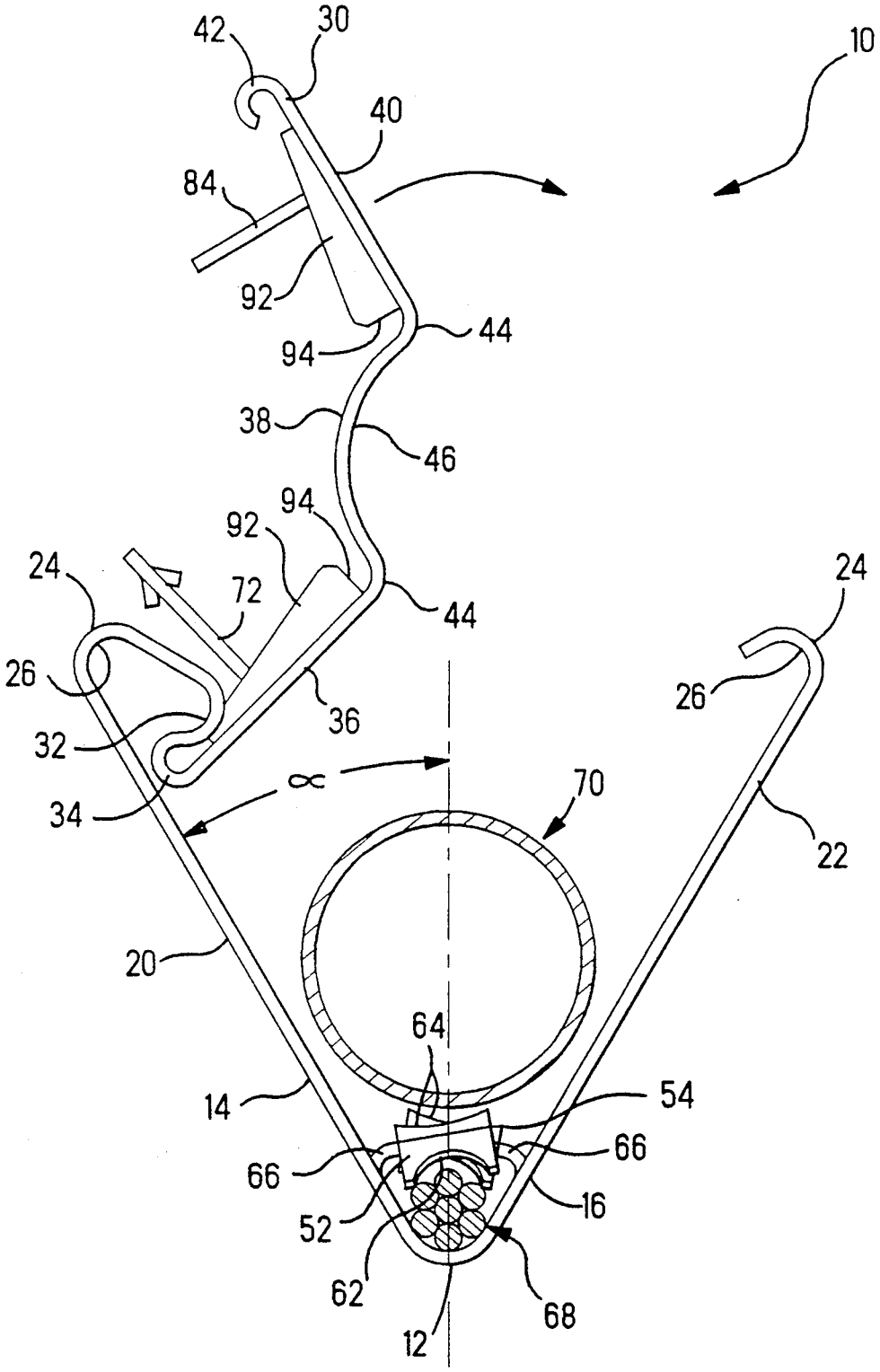
FIGS. 5 to 7 are elevation views of the connector of FIGS. 1 to 3 prior to mounting, after mounting and after crimped application to a pipe and a round wire, respectively.

Connector 10 includes a base section 12 and outer walls having lower wall sections 14,16 extending upwardly therefrom and diverging to define V-shaped channel 18, and upper wall sections 20,22 continuing outwardly from lower wall sections 14,16 to bends 24 at outermost extents thereof. Lower and upper wall sections 14,20;16,22 diverge outwardly from base section 12 at selected angles $\alpha$ from vertical (FIG. 5). Upper wall sections 20,22 are bent back inwardly at bends 24 to form slots 26.

Clamping section 30 extends from upper wall section 20 and includes a hinge joint 32 integral with bend 24 thereof, a first bend 34 extending from hinge joint 32, and in succession a first inner wall section 36, an arcuate central portion 38, and a second inner wall section 40 concluding in a second bend 42. Initially, clamping section 30 extends in a direction generally away from base section 12 permitting the connector to be easily placed around a continuous portion of a large diameter pipe (see FIG. 5). Central portion 38 is arcuate outwardly and joins inner ends of wall sections 36,40 at radiused third bends 44. The concave inwardly facing surface of central portion 38 defines clamping surface 46 associated and engageable with an upper surface of a second large diameter conductor such as a pipe upon crimping, with the radius of concave clamping surface 46 generally equal to the radius of the pipe.

Referring to FIG. 2, clamping section 30 has been rotated about hinge joint 32 to extend between the outer extents of upper wall sections 20,22. First and second bends 34,42 are disposed within slots 26 inside of bends 24 at the outer extents of upper wall sections 20,22, with second bend 42 latched within the respective slot 26 under spring bias generated by hinge joint 32. Wall sections 36,40 now extend downwardly and inwardly within upper wall sections 20,22 and will hereafter be referred to as inner walls 36,40 while upper wall sections 20,22 will hereafter be referred to as outer walls 20,22. Inner walls 36,40 are now oriented at selected angles $\beta$ (FIG. 6) which are greater than angles $\alpha$ of outer walls 20,22.

Figure 4:
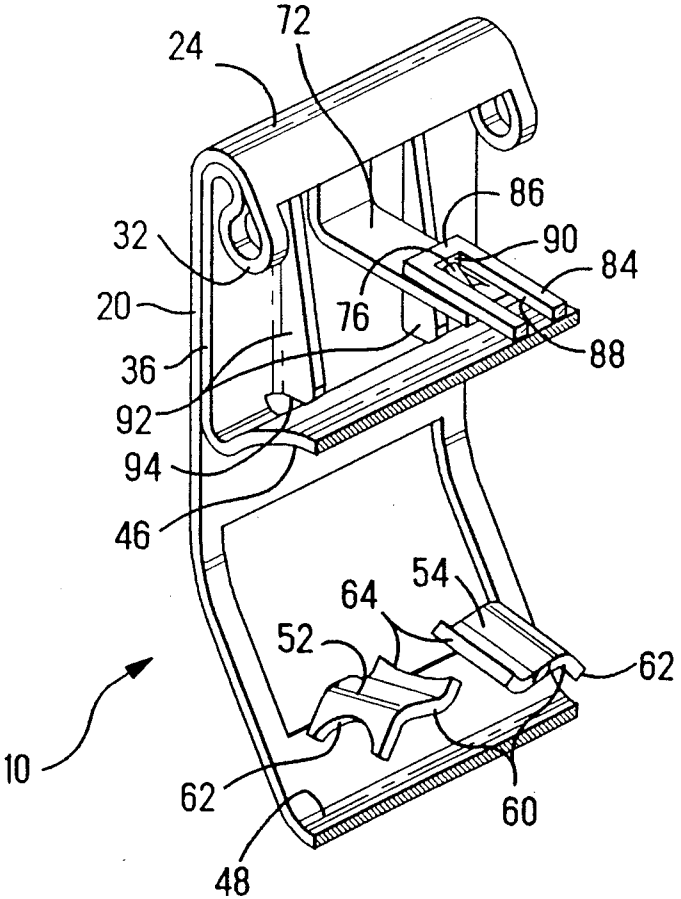
FIG. 4 is a section view taken along an intersecting vertical plane through the connector of FIG. 3.
Figure 8:
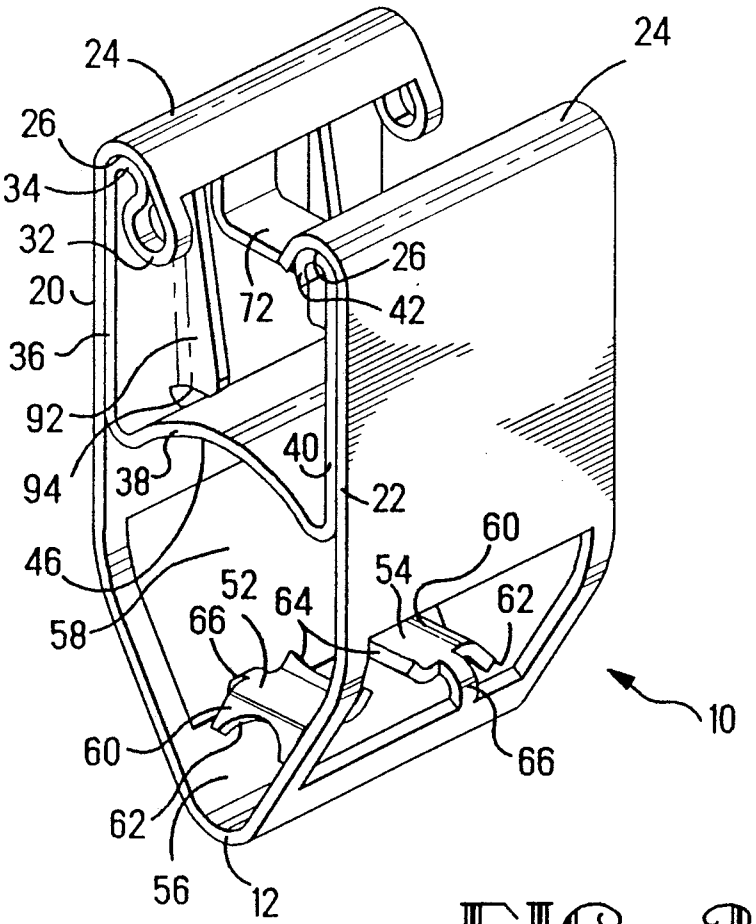

Referring to FIGS. 2 to 4, concave clamping surface 46 now faces downwardly toward the inside surface 48 of base section 12, with both generally defining therebetween a conductor-receiving region 50. Near inside clamping surface 48 of base section 12, a pair of undulate or contoured insert tabs 52,54 extend inwardly each from a respective one of lower wall sections 14,16 generally forming an insert section dividing conductor-receiving region 50 into lower and upper conductor-receiving passageways 56,58.

With reference now to FIGS. 4 and 5, each contoured insert tab 52,54 comprises a plate portion 60 extending between a first end portion concluding in a first or lower engagement edge 62 and a second end portion concluding in a second or upper engagement edge 64, and is joined to a lower wall section 14,16 by a strap 66. First or lower edges 62 are concave to correspond with the surface of a round wire first conductor 68 and are spaced apart to engage the round wire at spaced axial locations therealong; second or upper edges 64 are concave to correspond with the lower surface of a large diameter pipe second conductor 70, and are spaced apart to engage the pipe at spaced axial locations therealong.

Each plate section 60 is generally oriented slightly upwardly from horizontal extending inwardly into V-shaped channel 18 to be rotated about straps 66 upon crimping to a generally horizontal orientation. Further, each insert tab 52,54 is undulate or contoured so that respective end portions of plate section 60 adjacent first and second edges 62,64 extend downwardly and upwardly from at angles of about 30° from the vertical for a sharp corner of the edge to engage the wire or pipe surface and penetrate the corrosion thereon, and also to be wiped along the surfaces when insert tabs are generally somewhat flattened under compression between pipe 70 and ground wire 68 during final stages of crimping.

In FIG. 5 connector 10 is being mounted about a portion of a continuous large diameter pipe 70, with pipe 70 positioned above insert tabs 52,54 and an end portion of a grounding wire 68 routed below the insert tabs against clamping surface 48 defined by base section 12 forming the bottom of the V-shaped channel 18. Alternatively connector 10 can be mounted to a portion of a continuous length of ground wire 68 by manipulating the wire or the inset tabs 52,54 or both until the wire is worked between and under the insert tabs and along base section 12.

Figure 6:
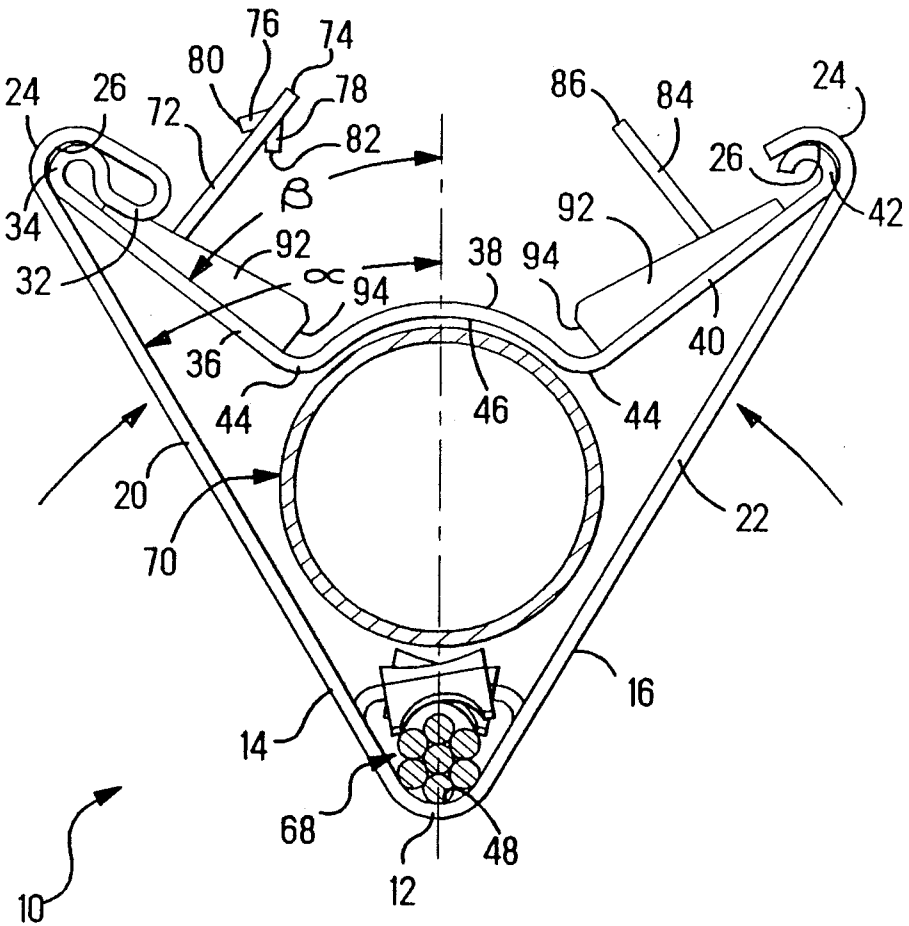

In FIG. 6 clamping section 30 has been rotated downwardly about hinge joint 32 until first bend 34 has entered associated slot 26 at bend 24 of outer wall 20 and second bend 42 has latched into its associated slot 26 at bend 24 of outer wall 22. Clamping surface 46 of central portion 38 is not proximate the upper surface of pipe 70 and inner walls 36,40 extend at angles $\beta$ from vertical diverging from outer walls 20,22 which are oriented at angles $\alpha$ from vertical less than angles $\beta$.

Figure 7:
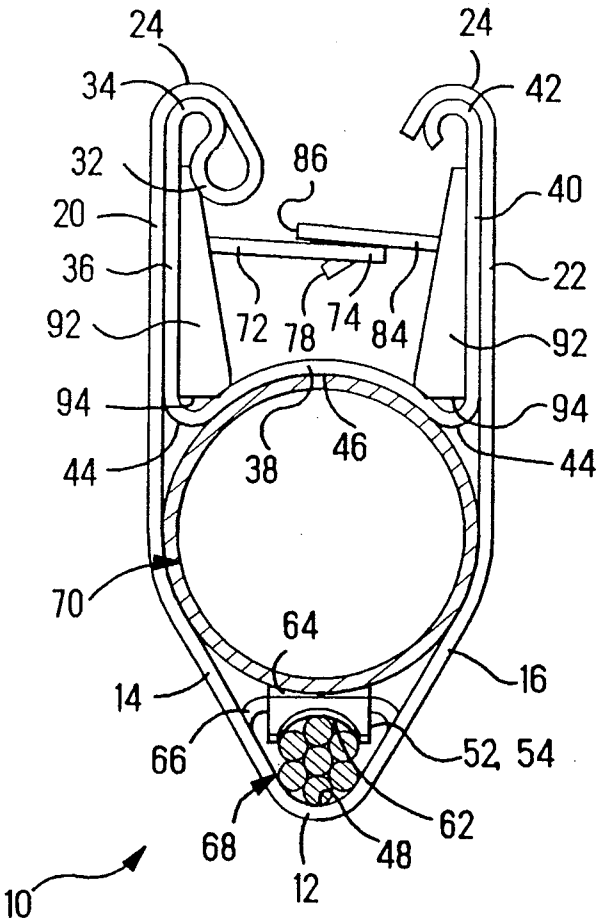

Referring now to FIG. 7, crimping is easily performed by squeezing outer walls 20,22 at upper extents thereof toward each other such as with pliers, rotating outer walls 20,22 about pipe 70. First and second bends 34,42 of inner walls 36,40 firmly engage bottoms of slots 26; continued rotation of outer walls 20,22 toward each other during crimping in turn rotates inner walls 36,40 toward each other about joints 44 which define pivot points, until both outer and inner walls attain a vertical orientation.

During crimping, free ends 34,42 of inner walls 36,40 are trapped in bent-back free ends 24 of outer walls 20,22; rotation of inner walls 36,40 to vertical causes central portion 38 to move relatively downwardly toward base section 12, since inner walls 36,40 are rotated through a greater angle than are outer walls 20,22.

Connector 10 is stamped and formed in its final shape form a strip of metal having spring properties such as brass alloy no. 260 half hard temper or stainless steel and having a general thickness of about 0.040 inches. Outer walls 20,22 preferably are formed at an angle $\alpha$ of about 20° to about 40° and preferably about 30° from vertical and bends 24 define partially open slots 26 with radiused bottoms at least as wide as the outer surfaces of first and second bends 34,42 of clamping section 30. Clamping section 30 has a selected length and shape so that after rotation and latching to outer wall 22, inner walls 36,40 are oriented to extend at a angle $\beta$ which may be from about 35° to about 55° and preferably about 45° from vertical.

Also shown especially in FIGS. 6 and 7 is a locking arrangement for locking connector 10 together upon full crimping. First locking lance 72 extends at a right angle inwardly and upwardly from inner wall 36 to a free end 74 in which is formed upper and lower locking projections 76,78 defining lock surfaces 80,82 facing inner wall 36. Second locking lance 84 similarly extends inwardly and upwardly at aright angle form inner wall 40 to a free end 86 and includes a slot 88 defining a corresponding lock surface 90 facing inner wall 40, best seen in FIG. 4. Free ends 74,86 meet and begin to interleaf upon inner walls 36,40 being rotated to a vertical orientation, and irrespective of either free end passing over or under the other, one of locking projections 76,78 will enter slot 88 and the locking surface 80 or 82 thereof will oppose and lock behind locking surface 90. Locking lances 72,84 prevent inner walls 36,40 and perforce outer walls 20,22 from being opened outwardly and also serve as a visual indication of full crimping thereafter.

In FIG. 7, outer walls 20,22 have been urged toward each other by pliers until vertical, bending generally about pipe 70, urging inner walls 36,40 to a vertical orientation and translating central portion 38 downwardly for concave clamping surface 46 thereof. In turn, clamping surface 46 clamps against the top surface of pipe 70 and urges pipe 70 against second or upper engagement edges 64 of insert tabs 52,54. As a result, first or lower engagement edges 62 of insert tabs 52,54 are clamped tightly against wire 68 which is thus clamped against clamping surface 48 of V-shaped base section 12. Free ends 74,86 of locking lances 72,84 are interlocked. Engagement edges 62,64 establish electrical connections with conductive material of grounding wire 68 and pipe 70, respectively, thus groundingly connecting them.

Best seen in FIG. 7 wherein connector 10 has been fully crimped, it is preferred to provide support flanges 92 upturned from inner walls 36,40 to define support ledges 94 engageable with top surface portions of central portion 38 upon full crimping at axially spaced locations axially along both sides. Such support flanges 92 provide an upper stop when clamping surface 46 is clamped tightly against the upper surface of pipe 70 and minimize deformation and possible weakening of rounded joints 44, and provide for generally even levels of clamping at four separate locations.

Other variations may be devised which are within the spirit of the invention and the scope of the claims. It is also within the spirit of the invention to utilize other structures which when crimped together, clamp a pair of wire-clamping surfaces of the connector against a pair of wires and cause edges or teeth along the V-shaped channel walls or the central portion of the clamping section themselves to break through the wire corrosion and interconnect the wire and pipe to establish an assured grounding path.

What is claimed is:

1. An electrical grounding connector for interconnecting lengths of a pair of conductive members, comprising:

a one-piece stamped and formed metal member including a base section and opposing outer walls extending upwardly and initially outwardly therefrom to outer extents to define generally a V shape, and a clamping section extending integrally from a hinge joint with said outer extent of one of said outer walls and including a first inner wall section, a central portion and a second inner wall section concluding in a latching means, said first and second inner wall sections being joined to said central portion at bendable joints and having outer extents remote from said bendable joints, said clamping section being rotatable against spring bias toward the other of said outer walls to latch with cooperating latching means of a said outer extent of the other of said outer walls in closed position, said base section defining a first conductor-clamping surface and said central portion of said clamping section being opposed therefrom and defining a second conductor-clamping surface, said first and second conductor-clamping surface, said first and second conductor-clamping surfaces defining a conductor-receiving region therebetween;

said member further including an insert section disposed between said first and second conductor-clamping surfaces and defining first and second conductor-receiving passageways, said insert section including conductor-engaging means defined along said first and second conductor-receiving passageways and engageable with surfaces of lengths of first and second conductors to be disposed therewithin, and said member defining a conductive path between said first and second conductors upon termination thereto;

said outer walls having upper sections, and said first and second inner wall sections being disposed proximate inside surfaces of said outer walls when said calming section is latched in its closed position, said upper sections of said outer walls diverging at a selected first angle from vertical, and said first and second inner wall sections diverging at a slightly greater selected angle from vertical when said clamping section is in its closed position;

said upper sections including engagement means proximate outer extents thereof firmly engageable during crimping with cooperating engagement means of said first and second inner walls sections outer extents thereof, whereby when first and second conductors are positioned along said first and second conductor-receiving passageways respectively, and when said upper sections of said outer walls are deformed by being rotated toward each other about an upper one of said first and second conductors, said first and second inner wall sections therebetween are correspondingly rotated by said outer wall upper sections toward each other about said bendable joints and said cooperating engagement means are engaged by said engagement means and cause said first and second inner wall sections to urge said central portion of said clamping section toward said base section pressing said first and second conductor-clamping surfaces against respective ones of said conductors disposed in said conductor-receiving passageways and during said conductor-engaging means against said conductors to establish an electrical interconnection sufficient to define a grounding connection therebetween.

2. An electrical grounding connector as set forth in claim 1 wherein said engagement means comprises said outer extents of said outer wall upper sections being bent back along said inside surfaces thereof to define slots, and said cooperating engagement means comprises said outer extents of said first and second inner wall sections being bent back and shaped to be received into said slots upon said clamping section being rotated into said closed position and to fit snugly within said slots upon full crimping of said member to said first and second conductors.

3. An electrical grounding connector as set forth in claim 1 wherein said bendable joints are rounded to facilitate bending thereat.

4. An electrical grounding connector as set forth in claim 1 especially suitable for use in grounding a wire to a pipe with the wire and the pipe being the first and second conductors, wherein said base section is rounded having an inner radius about equal to the radius of a respective said wire to be grounded, and said central portion of said clamping section is arcuate upwardly to define a concave clamping surface having a radius about equal to the radius of a respective said pipe to which said wire is to be grounded.

5. An electrical grounding connector as set forth in claim 4 wherein said first and second inner wall sections each include a pair of vertical support wings extending inwardly therefrom defining support ledges proximate said bendable joints to engage and support upper surface portions of said central portion at two axial locations on each side therealong during final stages of crimping for support to assure uniform bending thereof.

6. An electrical grounding connector as set forth in claim 1 wherein each of at least said upper sections of said outer walls are oriented at a first selected angle of about from 20° to about 40° from vertical, and each of said first and second inner wall sections are oriented at a second selected angle greater than said first selected angle.

7. An electrical grounding connector as set forth in claim 6 wherein said second selected angle is about from 35° to about 55° from vertical.

8. An electrical grounding connector as set forth in claim 7 wherein said first selected angle is about 30° and said second selected angle is about 45°.

9. An electrical grounding connector as set forth in claim 1 further including locking means for locking said first and second inner wall sections together upon full crimping and mechanically assuring and visually indicating that the assembly has attained a fully crimped configuration.

10. An electrical grounding connector as set forth in claim 9 wherein said locking means is defined by first and second locking lances extending from said first and second inner wall sections respectively and toward each other when said first and second inner wall sections have been rotated to a vertical orientation upon full crimping, and free ends of said locking lances are adapted to lockingly engage when said free ends coextend alongside each other.

11. An electrical grounding connector as set forth in claim 10 wherein free ends of said first and second locking lances overlap each other when said member is fully crimped, said first locking lance includes locking projections extending to locking surfaces facing away from said free end of said first locking lance and outwardly of upper and lower surfaces of said first locking lance, and said second locking lance includes a slot extending away from said free end thereof beginning at an inside edge facing away from said free end thereof at a location proximate thereto and defining a cooperating locking surface, said slot of said second locking lance thereby being capable of receiving either one of said locking projections thereinto permitting said first locking lance to resile against said second locking lance thereby locking said first and second inner wall sections in a fully crimped orientation irrespective of said free end of said first locking lance passing over or under said free end of said second locking lance.

12. An electrical grounding connector as set forth in claim 1, wherein said conductor-engaging means comprise opposed first and second engagement edges of plate sections of at least one insert tab joined integrally to a respective at least one said outer wall and defining said insert section.

13. An electrical grounding connector as set forth in claim 12 wherein a said insert tab is joined to each said outer wall and extends inwardly into said conductor-receiving region at staggered locations along said base section, said plate section of each said insert tab being oriented generally horizontally with a first end portion angled downwardly to said first engagement edge, and a second end portion angled upwardly to said second engagement edge, for engaging said first and second conductors at angles enabling wiping along engaged surfaces of said first and second conductors for breaking through corrosion thereon.

14. An electrical grounding connector as set forth in claim 13 wherein said insert tabs are joined to said outer walls by straps enabling deflection and limited rotation of said plate sections during crimping.

* * * * *

UNITED STATES PATENT AND TRADEMARK OFFICE

CERTIFICATE OF CORRECTION

PATENT NO. : 5,164,545

DATED : November 17, 1992

INVENTOR(S) : Earl Raymond Kreinberg, et al.

It is certified that error appears in the above-identified patent and that said Letters Patent is hereby corrected as shown below:

In Claim 1, Column 7, Line 60 - "during" should be --urging--

Signed and Sealed this

Fifth Day of October, 1993

*Attest:*

*Attesting Officer*

BRUCE LEHMAN

*Commissioner of Patents and Trademarks*